US006138576A

United States Patent [19]

Szatrowski

[11] Patent Number: 6,138,576

[45] Date of Patent: Oct. 31, 2000

[54] DEVICE FOR PIVOTAL CONNECTION OF NEIGHBORING CAR BODIES OF A RAIL VEHICLE, ESPECIALLY FOR COMMUTER TRAFFIC

[75] Inventor: Leszek Szatrowski, Moers, Germany

[73] Assignee: Duewag Aktiengesellschaft, Krefeld, Germany

[21] Appl. No.: 09/296,727

[22] Filed: Apr. 22, 1999

[30] Foreign Application Priority Data

May 5, 1998 [DE] Germany ..... 198 19 927

[51] Int. Cl.[7] ..... B61D 17/00; B60D 5/00

[52] U.S. Cl. ..... 105/4.1; 280/403

[58] Field of Search ..... 105/3, 8.1, 15, 105/16, 17, 329.1, 4.1; 280/403, 408, 410, 419, 461.1, 424; 213/75 R

[56] References Cited

U.S. PATENT DOCUMENTS

| | | | |
|---|---|---|---|
| 3,884,155 | 5/1975 | Maroshick | 105/4 R |
| 4,405,143 | 9/1983 | Rosenkrands | 280/403 |
| 4,625,652 | 12/1986 | Losa et al. | 105/4.1 |
| 5,052,707 | 10/1991 | Timan | 280/403 |
| 5,197,392 | 3/1993 | Jeunehomme | 105/3 |
| 5,377,597 | 1/1995 | Richter et al. | 105/4.1 |

FOREIGN PATENT DOCUMENTS

| | | |
|---|---|---|
| 1 207 220 | 12/1965 | Germany . |
| 27 29 883 | 1/1978 | Germany . |
| 44 46 282 A1 | 4/1994 | Germany . |
| 44 22 581 A1 | 1/1996 | Germany . |

*Primary Examiner*—S. Joseph Morano
*Assistant Examiner*—Patrick Craig Muldoon
*Attorney, Agent, or Firm*—Michael J. Striker

[57] ABSTRACT

In the device for pivotally connecting neighboring car bodies of a rail vehicle, especially for commuter traffic, each car body (1,2) is supported by a ball-and-socket joint (6) on a common swiveling railway truck (4). The swiveling railway truck (4) carries a central portal (3) between the car bodies and the central portal (3) is coupled kinematically by means of a swiveling linkage mechanism with them in the vicinity of a roof of the car bodies. The swiveling linkage mechanism includes car body arms (7) pivotally connected to the car bodies (1,2) and central portal arms (8) pivotally connected with the central portal (3) and with the car body arms (7). Both car bodies (1,2) and the central portal (3) form lower legs of two kite-shaped quadrilateral linkages and the car body arms (7) and the central portal arms (8) form the upper legs of the quadrilateral linkages. Both central portal arms (8) are guided with the help of a control device (10,11) mounted on the central portal so that they take identical angles ($\alpha$) in relation to the vertical axis of the central portal (3).

3 Claims, 5 Drawing Sheets

DEVICE FOR PIVOTAL CONNECTION OF NEIGHBORING CAR BODIES OF A RAIL VEHICLE, ESPECIALLY FOR COMMUTER TRAFFIC

BACKGROUND OF THE INVENTION

The present invention relates to devices for connecting the neighboring car bodies of a vehicle that travels on rails and, more particularly, to means for connecting rail car bodies used for local traffic.

In the device for pivotal connection of neighboring rail car bodies, especially for local or commuter traffic, each car body is supported by a ball-and-socket joint on a common swiveling railway truck, and a central portal is arranged between the car bodies and coupled kinematically with them by a swiveling linkage mechanism in the vicinity of the roof.

One device with the above-described features has been embodied in a special metropolitan transit car and is part of the state of the art. The central portal operates to connect bellows that cover the pivotal connection region. In order to attain as equal shaped sections of the covering bellows as possible on both sides of the central portal during travel around rail curves, hollows and domes, angle-bisecting positions in relation to both bounding car bodies are desired for the central portal.

SUMMARY OF THE INVENTION

It is an object of the present invention to provide a device for pivotal connection of neighboring car bodies of a rail-traveling vehicle of the above-described kind, which is formed in a simple and compact manner, so that the angle between the central portal and the respective car bodies is exactly halved or bisected in all travel situations.

This object and others which will be made more apparent hereinafter is attained in a device for pivotally connecting neighboring rail car bodies, especially for local or commuter traffic, in which each car body is supported by a ball-and-socket joint on a common swiveling railway truck and a central portal is arranged between the car bodies and coupled kinematically with them by a swiveling linkage mechanism in the vicinity of the roof of the car bodies.

According to the invention the swiveling linkage mechanism for kinematically coupling the central portal with the car bodies in the vicinity of the roof comprises two central portal arms pivotally connected to the central portal in the vicinity of the roof, car body arms pivotally connected to the respective car bodies in the vicinity of the roof and a control device connected with the central portal arms and the car body arms to guide the central portal arms so that the central portal arms each take identical angles in relation to a vertical axis of the central portal.

The central portal arms of the central portal are pivotally connected to the respective car body arms to form upper members of two three-dimensional kite-shaped quadrilateral linkages and the car bodies and central portal form lower members of the two three-dimensional kite-shaped quadrilateral linkages.

Preferred embodiments of this invention are described in more detail in the dependent claims and in the detailed description appended hereinbelow.

In a preferred embodiment of the invention the control device comprises a central transmission arm pivotally mounted on the central portal about a vertical transmission arm rotation axis passing through a central portion of the transmission arm and respective connecting rods having ball joints at opposite ends thereof pivotally connecting the connecting rods with respective opposite ends of the central transmission arm and with the central portal arms. Advantageously ball joints may be used for the pivotal connection of the car body arms and the central portal arms.

BRIEF DESCRIPTION OF THE DRAWING

The objects, features and advantages of the invention will now be illustrated in more detail with the aid of the following description of the preferred embodiments, with reference to the accompanying figures in which.

DESCRIPTION OF THE PREFERRED EMBODIMENT

Figure 1:
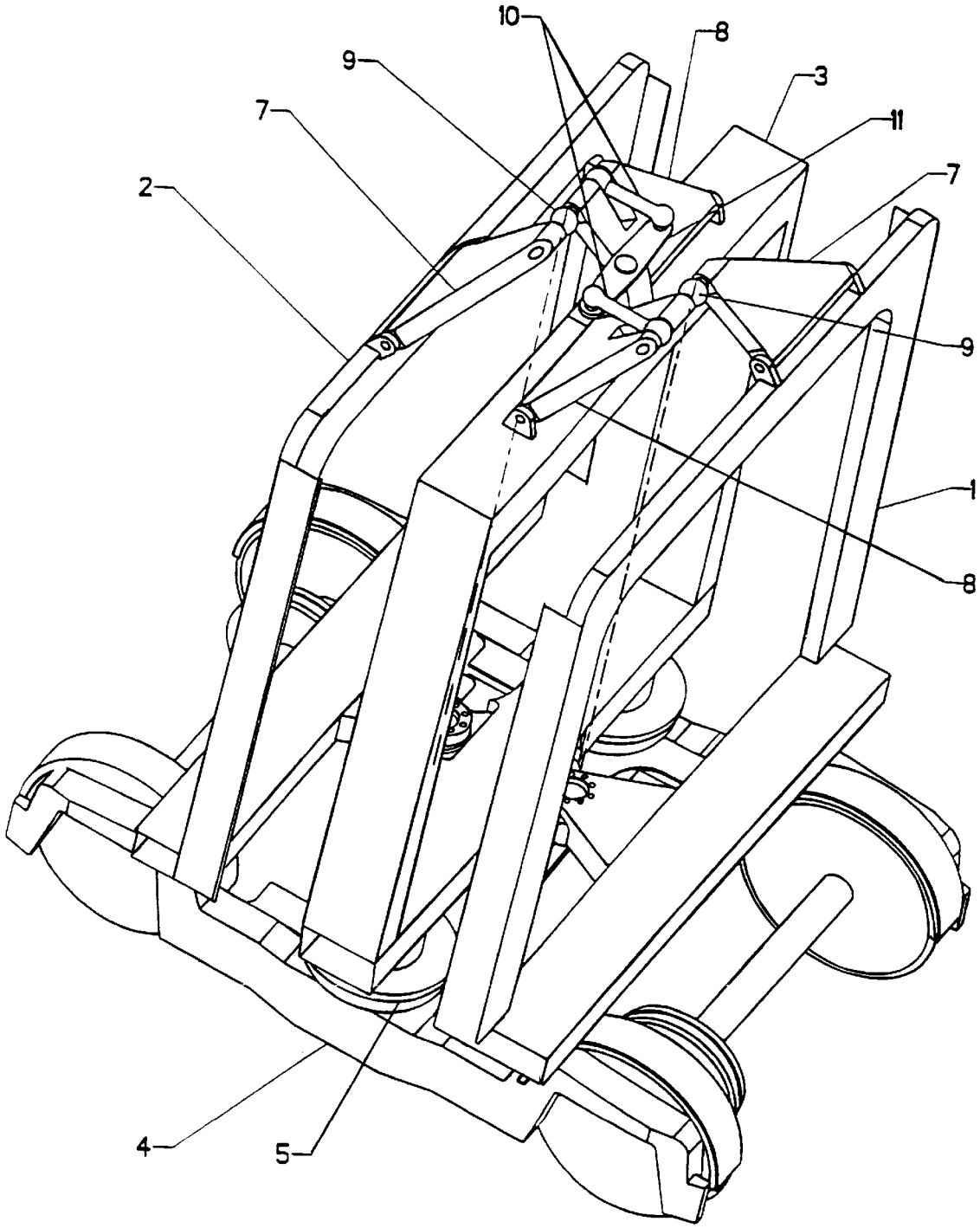
FIG. 1 is a perspective view of a swiveling linkage mechanism for adjacent car bodies of a rail vehicle according to the invention as seen while the rail vehicle is traveling in a straight line.
Figure 2:
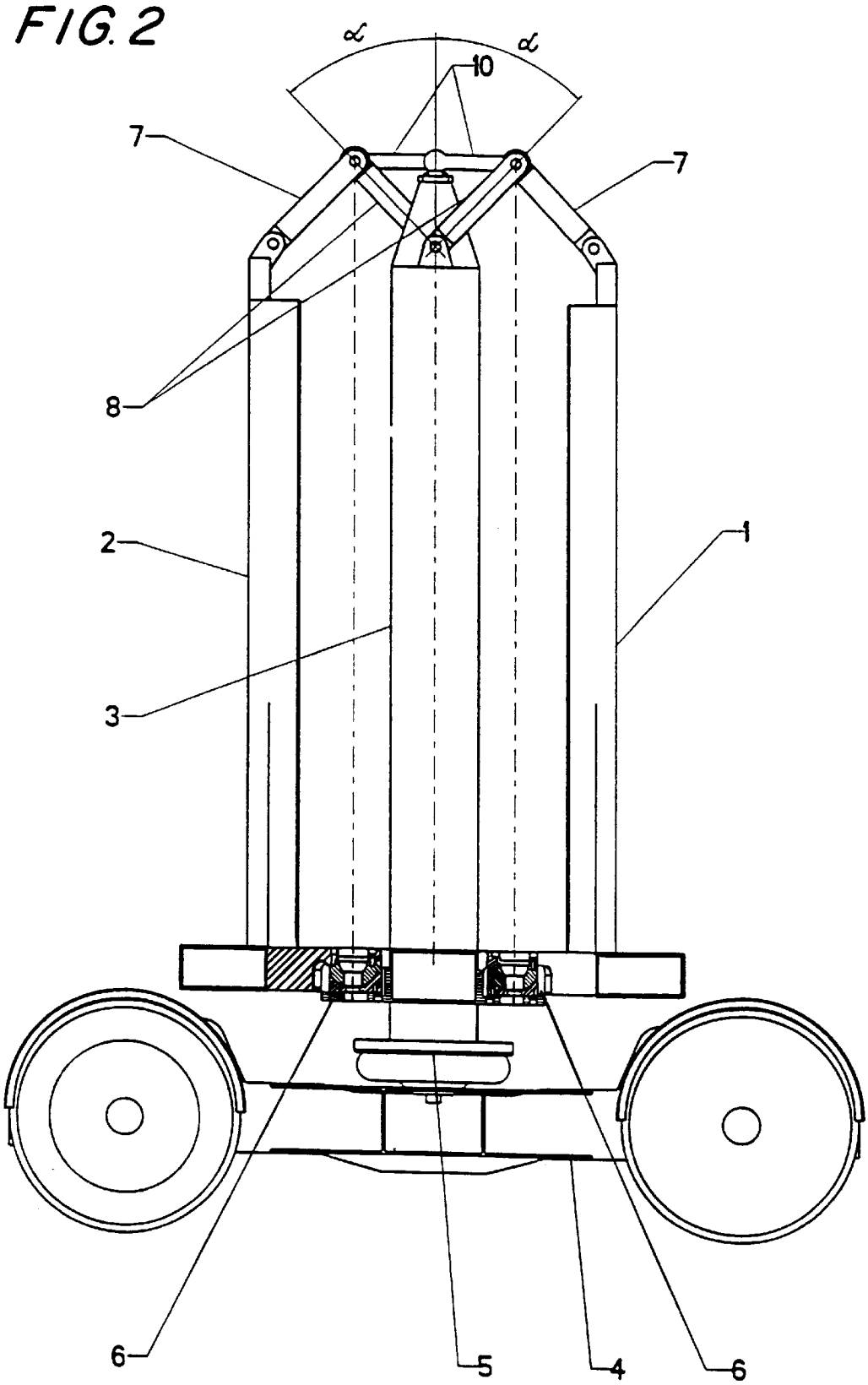
FIG. 2 is a partially side view, partially cutaway cross-sectional view of the swiveling linkage mechanism shown in FIG. 1, in which a lower portion is shown in crosssection.

In the drawing the two neighboring car bodies 1 and 2 of the rail-traveling vehicle are represented only with their frame end portions. These frame ends have a bearing bracket, in which an upper part of a ball-and-socket joint 6 is mounted. The lower part (ball socket) of this ball-and-socket joint 6 is held in a respective bearing bracket of a central portal 3. The central portal 3 is supported by an air spring 5 on a swiveling railway truck 4 on both car ends. Also the central portal 3 is connected by an unshown connecting member, for example a pivot or stop, to the swiveling railway truck 4. The car bodies 1 and 2 can therefore move in several planes relative to each other in the manner described hereinbelow indirectly on the common swiveling railway truck.

The car bodies 1 and 2 and the central portal 3 are kinematically coupled in the following manner by a connecting mechanism in the vicinity of the roof or the upper part of the rail vehicle. Each car body 1 and 2 has a car body arm 7. The central portal 3 has two central portal arms 8. All these arms 7 and 8 are pivotally connected on a horizontal rotation axis to the car bodies 1 and 2 and/or to the central portal 3. One car body arm 7 and one central portal arm 8 respectively are connected pivotally by a ball joint 9. A central transmission arm 11 is pivotally mounted on the central portal 3 so that it rotates about a vertical rotation axis. The transmission arm 11 is coupled by connecting rods 10 with respective central portal arms 8 by pivot joint at the ends of the transmission arm 11. The pivot joint at each end of the arms of the connecting rod can be a ball joint.

In alternative embodiments not shown in the drawing the foregoing purely mechanical parts may be replaced by drive means. For example, they may be replaced by hydraulic or electrical parts for the purposes of control and adjustment.

Figure 5:
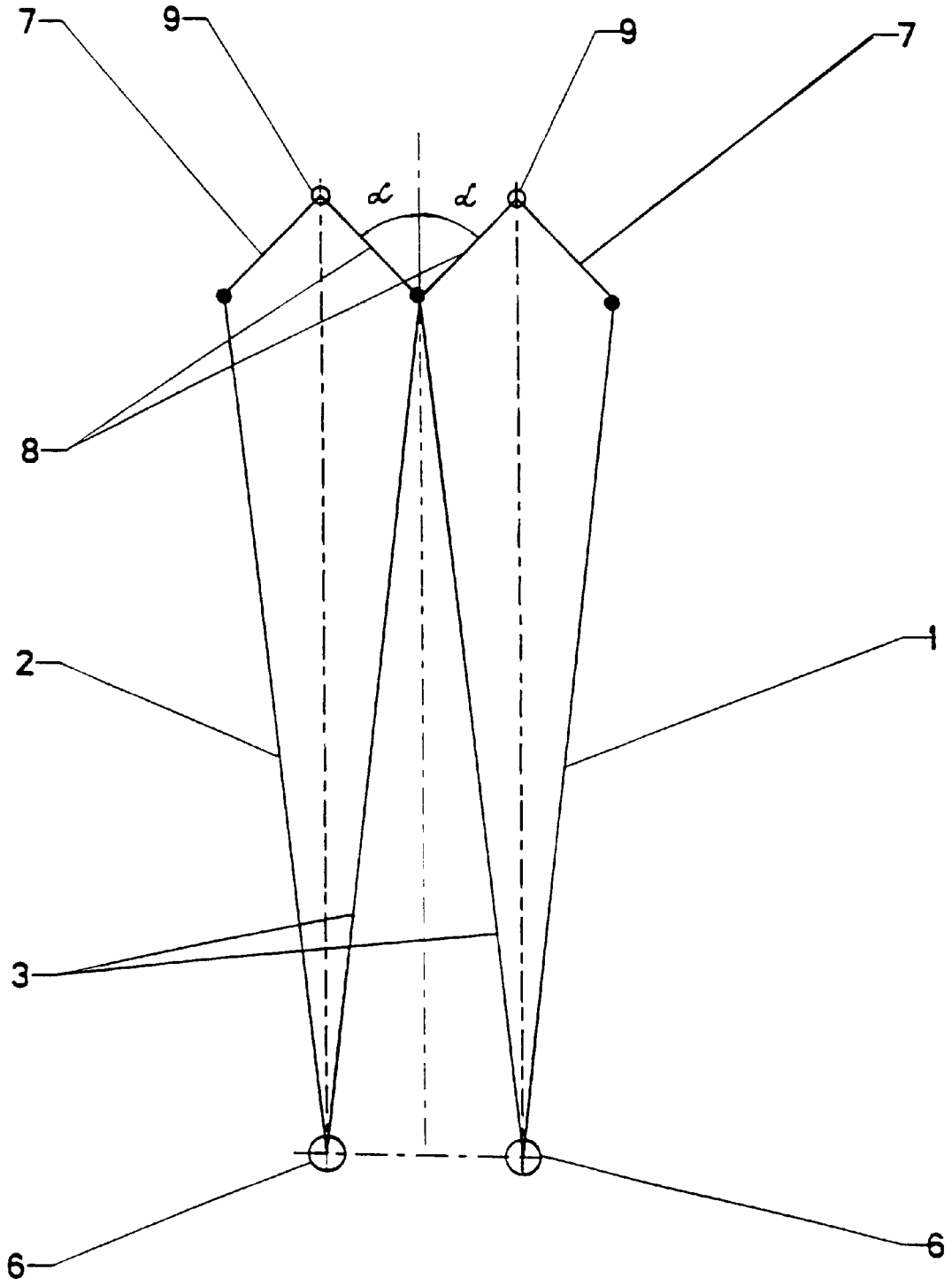
FIG. 5 is a diagrammatic side view during operation of the swiveling mechanism during straight-line travel.

As is especially apparent from the diagrammatic view in FIG. 5, both car bodies 1 and 2 and the central portal 3 form the lower part or legs of two three-dimensional kite-shaped quadrilaterals (deltoids). The upper parts of these quadrilaterals comprise pairs of car body arms 7 and central portal arms 8.

Figure 3:
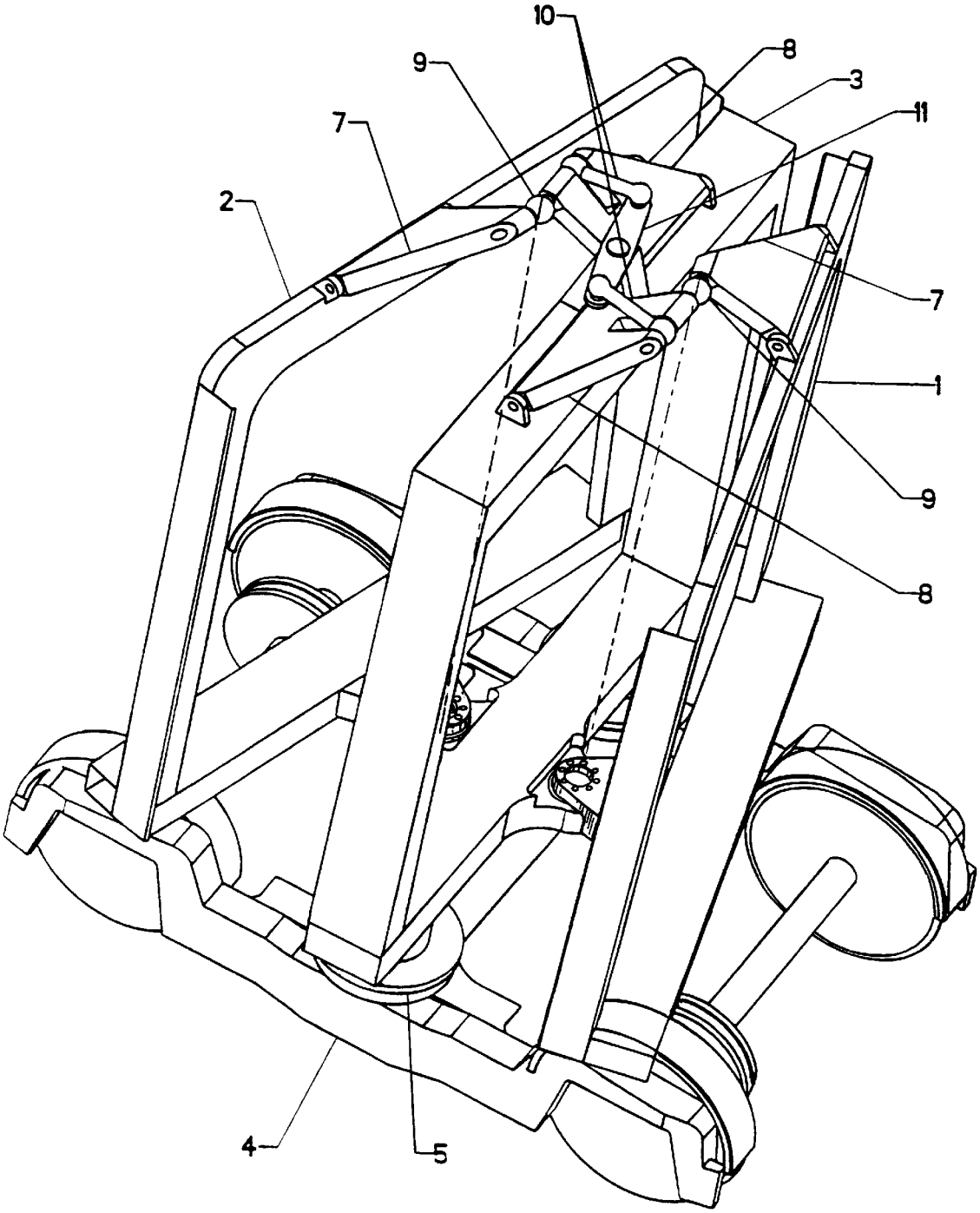
FIG. 3 is a perspective view of the swiveling linkage mechanism for adjacent car bodies during travel around a curve and at the same time travel over a hill or dome.
Figure 4:
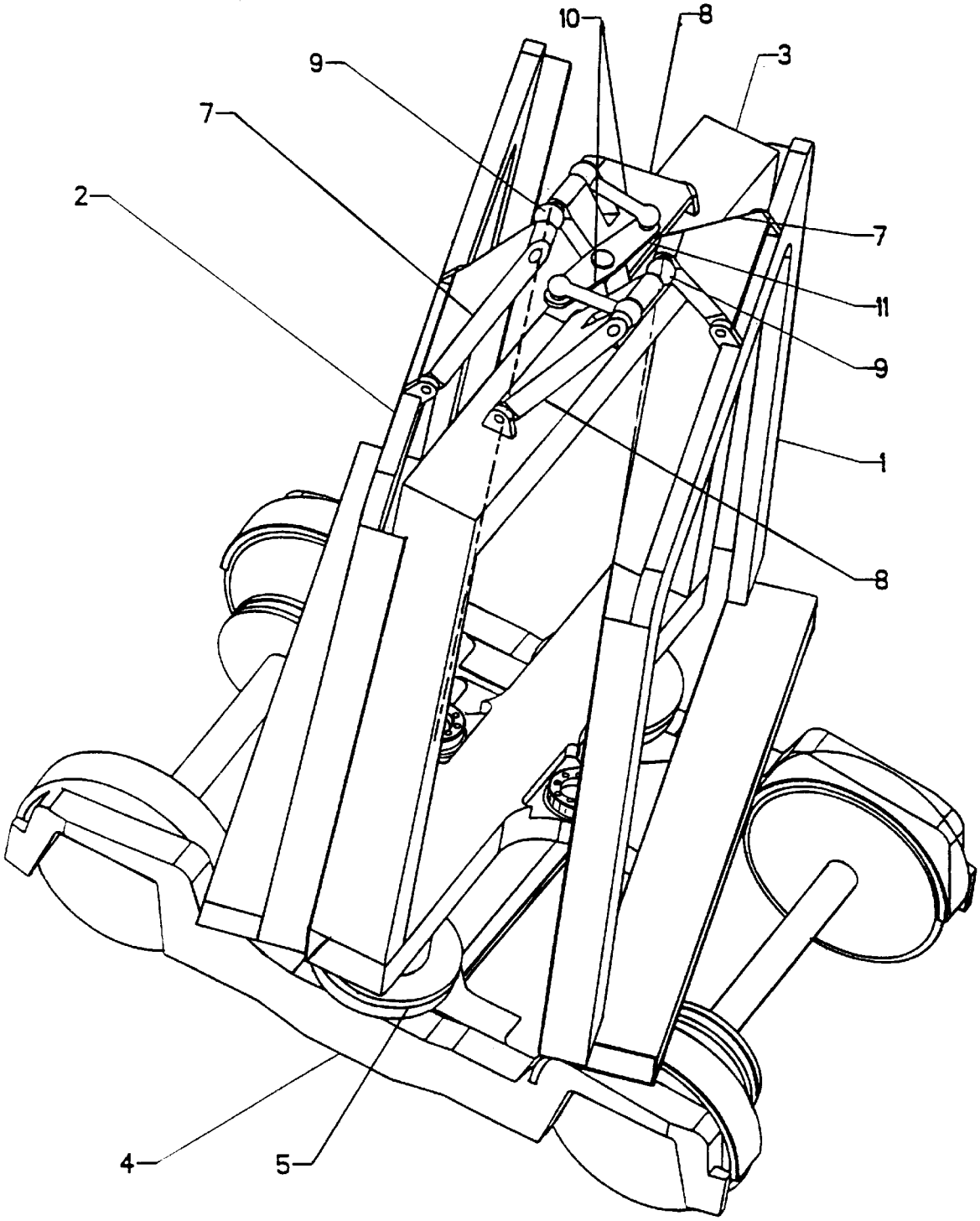
FIG. 4 is a perspective view of the swiveling linkage mechanism for connecting neighboring car bodies during travel around an S-curve and, at the same time, through a depression, although this situation seldom occurs in practice.

The central portal arm 8 takes the same identical angle $\alpha$ relation to the vertical axis of the central portal 3 in the sense of desired angle bisecting positions of the central portal 3 between the car bodies 1 and 2 both during travel around a curve and also in travel through a depression and over a hill or dome. It is understood that this angle $\alpha$ takes other numerical values $\alpha 1$ and $\alpha 2$ in the situations shown in FIGS. 3 and 4. Of course in these situations both angles $\alpha 1=\alpha 1$ and also $\alpha 2=\alpha 2$ are also equal.

Parts List

1 car body frame end portion (right)
2 car body frame end portion (right)
3 central portal with bearing bracket
4 swiveling railway truck
5 air spring
6 ball-and-socket joint
7 car body arm
8 central portal arm
9 ball joint between 7 and 8
10 connecting rod with ball joints at each end
11 transmission arm with central pivot axis
$\alpha$ angle between the central portal arm 8 and the vertical axis of the central portal 3.

The disclosure in German Patent Application 198 19 927.9 of May 5, 1998 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a device for pivotal connection of neighboring car bodies of a rail vehicle, especially for commuter traffic, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims:

I claim:

1. A device for pivotally connecting neighboring rail car bodies, said device comprising ball-and-socket pivot joints (6) for said car bodies (1,2) arranged on a common swiveling railway truck (4) so that each of said car bodies (1,2) is pivotally supported on said swiveling railway truck (4);

a central portal (3) arranged between the car bodies (1,2); and swiveling linkage means for kinematically coupling said central portal with said car bodies (1,2) in the vicinity of a roof of the car bodies, wherein said swiveling linkage means comprises two central portal arms (8) pivotally connected to said central portal (3) in the vicinity of said a roof, car body arms (7) pivotally connected to respective ones of said car bodies (1,2) in the vicinity of said roof and a control device (10,11) connected with said central portal arms (8) and said car body arms (7) to guide said central portal arms (7) so that said central portal arms each take identical angles ($\alpha$) in relation to a vertical axis of the central portal (3);

wherein said central portal arms (8) of said central portal (3) are pivotally connected to the respective car body arms (7) to form upper members of two three-dimensional kite-shaped quadrilateral linkages and the car bodies (1,2) and central portal (3) form lower members of the two three-dimensional kite-shaped quadrilateral linkages.

2. The device as defined in claim 1, wherein said control device (10,11) comprises a central transmission arm (11) pivotally mounted on the central portal (3) about a vertical transmission arm rotation axis passing through a central portion of said transmission arm and respective connecting rods (10) having ball joints at opposite ends thereof pivotally connecting said connecting rods (10) with respective opposite ends of said central transmission arm (11) and with said central portal arms (8).

3. The device as defined in claim 1, further comprising respective ball joints (9) for pivotally connecting said central portal arms (8) with said car body arms (7).

* * * * *